US007637000B2

(12) United States Patent
Clark

(10) Patent No.: US 7,637,000 B2
(45) Date of Patent: Dec. 29, 2009

(54) PLATED ANTENNA FROM STAMPED METAL COIL

(75) Inventor: Jeffrey A. Clark, Macomb Township, MI (US)

(73) Assignee: Continental Automotive Systems US, Inc., Auburn Hills, MI (US)

( * ) Notice: Subject to any disclaimer, the term of this patent is extended or adjusted under 35 U.S.C. 154(b) by 129 days.

(21) Appl. No.: 11/775,974

(22) Filed: Jul. 11, 2007

(65) Prior Publication Data

US 2008/0098589 A1 May 1, 2008

Related U.S. Application Data

(60) Provisional application No. 60/854,252, filed on Oct. 25, 2006.

(51) Int. Cl.
*H01P 11/00* (2006.01)
*H01Q 13/00* (2006.01)

(52) U.S. Cl. ..... 29/600; 29/601; 29/605; 29/606; 29/825; 205/205; 205/640; 343/700 MS; 343/723; 343/793; 343/895

(58) Field of Classification Search ..... 29/600, 29/601, 605, 606, 825; 343/700 MS, 723, 343/725–729, 793–795, 895; 205/205, 640
See application file for complete search history.

(56) References Cited

U.S. PATENT DOCUMENTS

| | | | | |
|---|---|---|---|---|
| 5,199,157 | A | 4/1993 | Kurz et al. | |
| 5,862,579 | A | 1/1999 | Blumberg | |
| 6,326,920 | B1 * | 12/2001 | Barnett et al. | 343/700 MS |
| 6,917,333 | B2 * | 7/2005 | Ikegaya et al. | 343/700 MS |
| 7,237,319 | B2 * | 7/2007 | Kasahara et al. | 29/602.1 |
| 7,256,738 | B2 * | 8/2007 | Uchibori et al. | 343/700 MS |
| 2007/0229360 | A1 * | 10/2007 | Yanagi et al. | 343/700 MS |

FOREIGN PATENT DOCUMENTS

| | | |
|---|---|---|
| DE | 2305874 | 8/1974 |
| DE | 10154217 | 10/2002 |
| EP | 1331692 | 7/2003 |

OTHER PUBLICATIONS

International Search Report and Written Opinion dated Nov. 19, 2007.

* cited by examiner

*Primary Examiner*—Derris H Banks
*Assistant Examiner*—Jeffrey Carley

(57) ABSTRACT

A method of fabricating an antenna includes the step of stamping an initial set of openings within a metal strip and then plating that metal strip on all exterior surfaces. Initial openings define portions of features of the completed antenna that require plating on all surfaces. Once the metal coil has been plated the metal strips are fed through a final stamping process that makes final cuts that correspond with the initially made openings. The final cuts are on surfaces that do not require plating on all of the exterior surfaces.

18 Claims, 4 Drawing Sheets

PLATED ANTENNA FROM STAMPED METAL COIL

CROSS REFERENCE TO RELATED APPLICATION

The application claims priority to U.S. Provisional Application No. 60/854,252 which was filed on Oct. 25, 2006.

BACKGROUND OF THE INVENTION

This invention generally relates to RF antennas. More particularly, this invention relates to a method of fabricating a plated RF antenna.

Transmitting devices such as a transmitter and a receiver for a remote keyless entry system require a radio frequency (RF) antenna. The RF antenna is typically fabricated from copper that is then plated with tin to facilitate soldering to a circuit assembly. Conventional RF antennas are delicate parts with long thin parts that must be handled with great care, and therefore at an increased cost. The plating material is applied after the RF antenna is stamped so that all surfaces can be thoroughly coated with plating. The stamped parts are fragile and require deliberate and careful handling that consumes an undesirable amount of time.

Accordingly, it is desirable to develop and design a process for plating parts that limits required handling of delicately featured parts.

SUMMARY OF THE INVENTION

An example method for fabricating an antenna for mounting onto a circuit board includes the initial step of stamping an unplated coil of metal strip with a plurality of initial openings that define portions of the RF antenna, plating the metal strip with the initial openings and finish stamping the final shape of the RF antenna to provide the completed part configuration.

The example stamping operation includes stamping initial openings and re-rolling the initially stamped metal strip into a coil. The metal coil with initial stamped openings is then plated in one process. The plating process includes depositing plating material on the exposed surfaces of the coil. Because the initial openings provide additional exposed surfaces in the plated metal strip, interior sides of those openings are also plated.

Once the metal coil has been plated, a final stamping process is formed that completes the RF antenna. The opening and final cuts performed during final stamping correspond to the openings created during the initial stamping process to form the completed plated shape.

These and other features of the present invention can be best understood from the following specification and drawings, the following of which is a brief description.

DETAILED DESCRIPTION OF THE PREFERRED EMBODIMENT

Figure 1:
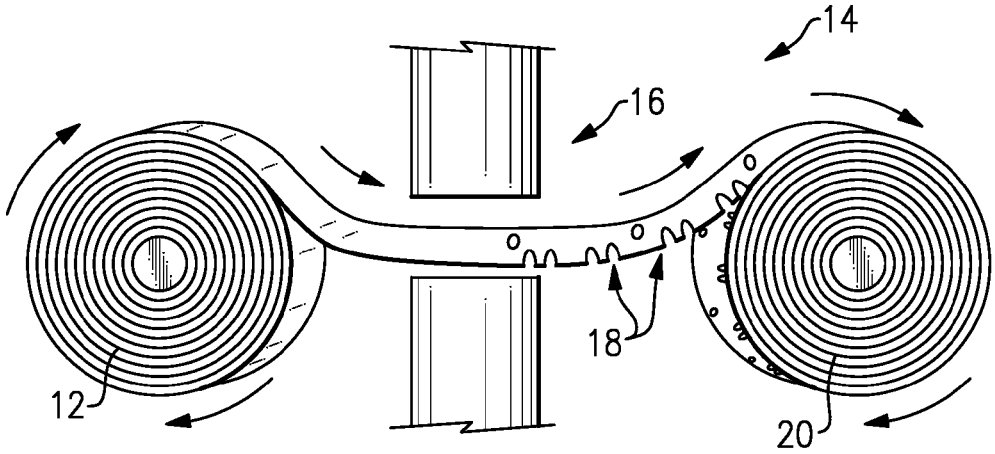
FIG. 1 is a schematic illustration of an initial step of the example method.

Referring to FIG. 1, the example process begins with an initial stamping process indicated at 14. During the initial stamping process 14 a bare coil of metal strip 12 is unrolled and stamped by a stamping press 16. The stamping press 16 creates initial openings 18 within the metal coil 12. The metal coil 12 is then re-rolled into an initially stamped coil 20. The initial openings 18 provide a portion of the features of the completed RF antenna by defining specific areas of the RF antenna to which plating is required on all surfaces.

The coil 12 of metal strip comprises a top surface, a bottom surface and two side surfaces. In normal plating operations the top surface, the bottom surface and the side surfaces are plated. However, additional stamping processes after plating result in some unplated surfaces. Therefore, conventional processes perform all the stamping operations prior to any plating steps.

Mounting of the RF antenna to a circuit board includes a soldering process that requires tin plating to be equally distributed on specific portions of the RF antenna. The tin plating is required to provide a desired soldered joint between the RF antenna and the circuit board. Conventional processes for stamping and fabricating the RF antenna include a complete stamping of the RF antenna followed by plating of the completed part. The RF antenna includes delicate fragile features that are susceptible to damage during plating and the handling that accompanies the plating process.

The example method and process includes initial stamping of the openings 18 to define portions of the RF antenna that require plating on all sides. The metal strip is not detached from the coil 12 but is recoiled as an initially stamped coil 20 which is in turn plated as a complete continuous metal strip. The plating material is therefore deposited on the top bottom and all side surfaces that are defined by the initial openings 18.

Figure 2:
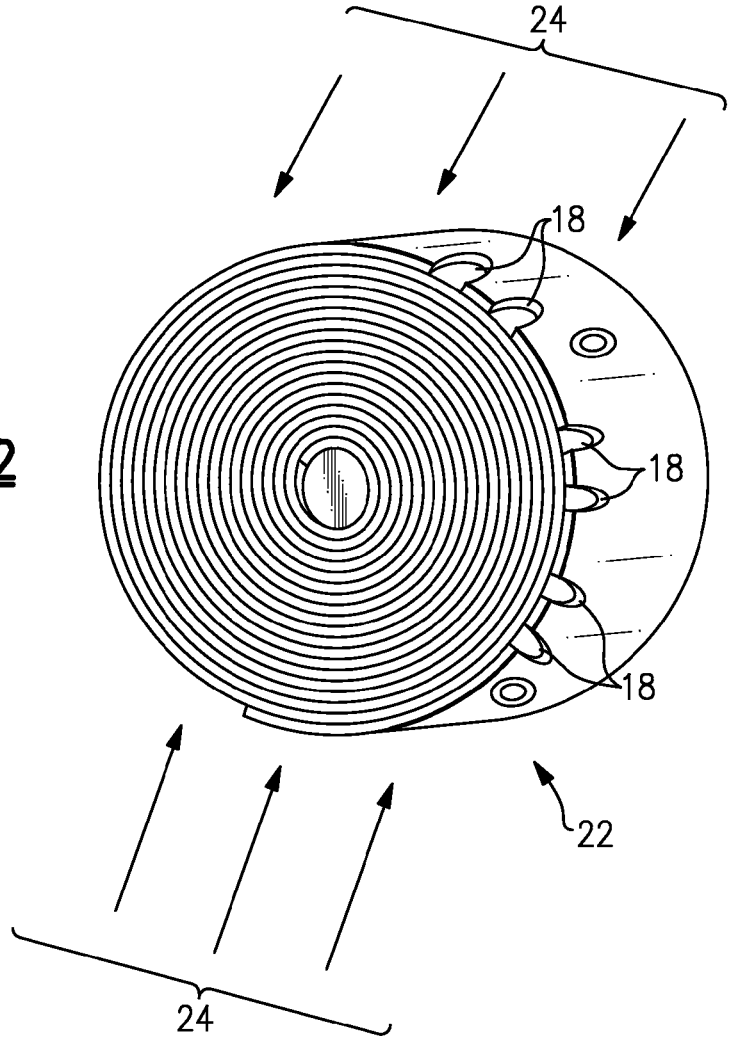
FIG. 2 is a schematic illustration of a plating of a metal coil.

Referring to FIG. 2, the entire re-rolled initially stamped metal coil 20 is plated as one single unit. Plating of the entire coil 22 of metal strip material as one complete unit eases handling concerns during this process and provides a more uniform thickness for the plating material being deposited on all surfaces of the metal strip.

Figure 3:
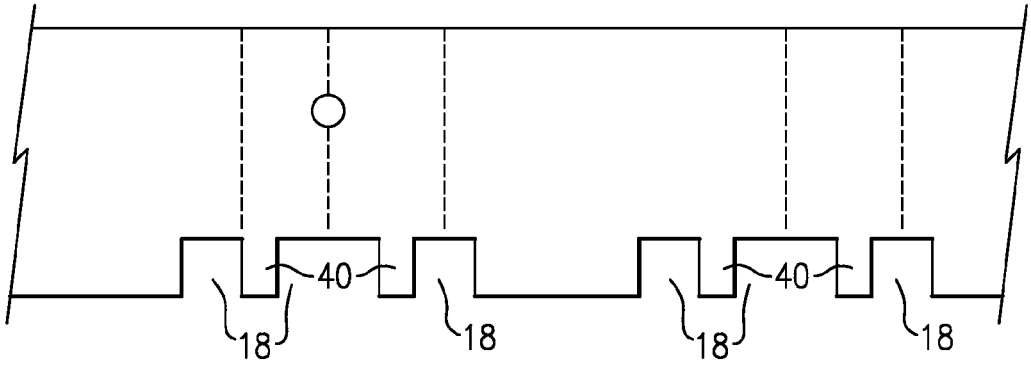
FIG. 3 is a side view of the initial opening stamped into the metal coil.

Referring to FIG. 3, the initially stamped metal strip includes features 40 that define portions of pins and other connecting elements of the RF antenna. The example initial openings 18 are created in the metal strip on each side of the connecting pins 40. The example initial openings 18 define portions of the connecting pins 40, but other features that require plating on all sides in the completed part could also be initially formed to accept plating on all sides prior to a complete stamped part.

Figure 4:
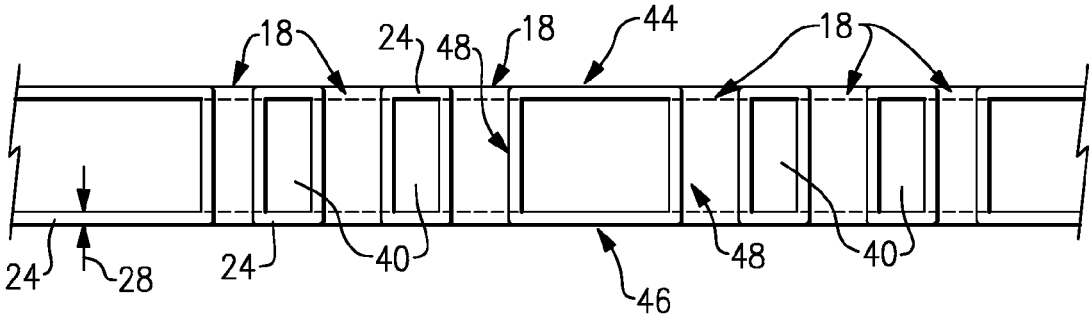
FIG. 4 is another side view of the initially stamped metal strip.

Referring to FIG. 4, during the plating process, the connecting pins 40 are plated on a top surface 44, a bottom surface 46 and each of side surfaces 48 to produce the desired complete plating of the part. The initial openings 18 provide for deposit of plating material 24 to the side surfaces 48 that are adjacent the connecting pins 40. The initial openings 18 thereby generate the desired transverse surfaces that accept plating on each side 48 of the connecting pins 40.

During plating, the top surface 44 and bottom surface 46 are plated along with the side surfaces 48 that are defined by the initial openings 18. The plating material 24 is deposited at a consistent uniform thickness on all exposed surfaces of the metal strip. This uniform deposit of plating material is carried through the transverse side surfaces 48 created by the initial openings 18.

Figure 5:
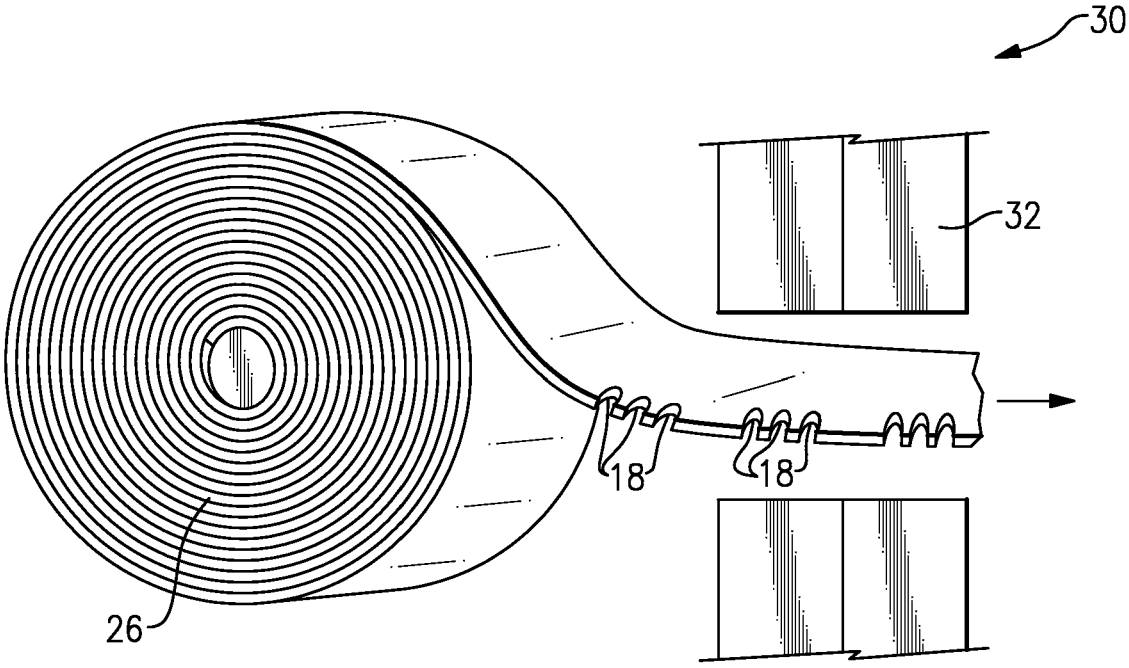
FIG. 5 is a schematic illustration of the final stamping process.
Figure 6:
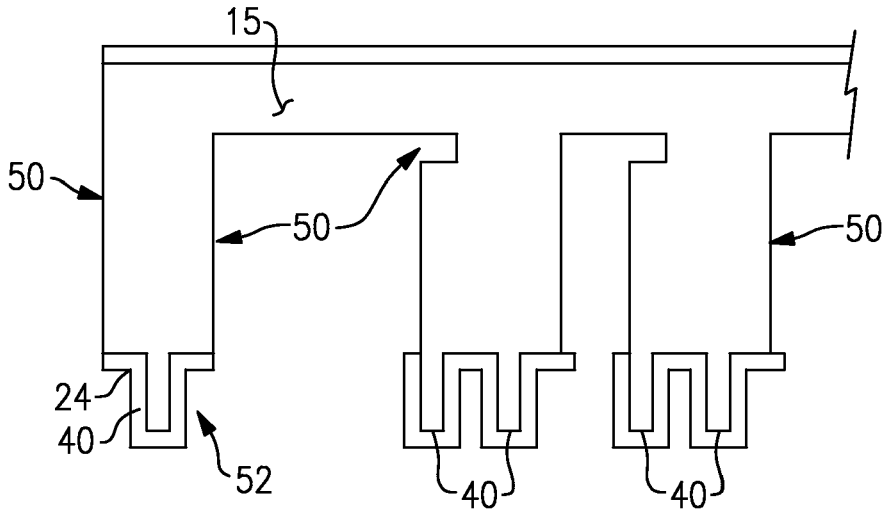
FIG. 6 is a schematic illustration of a portion of a completed RF antenna.

Referring to FIGS. 5 and 6, the plated coil 26 is then moved to a final stamping step for shaping the RF antenna 15 that is accomplished by utilizing the plated coil 26 with the initial openings 18. A final stamping press 32 completes the configuration of the RF antenna 15 by removing the remainder of material required to form the desired shape of the RF antenna. Because the initial openings 18 are already formed, the final stamping process removes material in portions where the plating material 24 is not required. The final stamping process 30 cuts the metal strip and results in some portions comprising bare unplated metal sides 80. However, because the initial openings 18 were previously cut and plated, these plated portions remain intact.

The RF antenna 15 is cut by the final stamping press 32. The final cutting process performed does not re-cut the initial openings 18, but performs cuts that correspond to the initial openings 18. Plated sides 52 of the pins remain intact, while other surfaces that are cut in the final stamping process comprise the bare unplated metal surfaces 50. The unplated surfaces 50 are not joint locations and therefore do not require the full plating that is required at each of the connecting pins 40.

Referring to FIG. 6, the example RF antenna 15 includes the plated connecting pins 40. The desired shape of these connecting pins 40 is initially defined at the initial stamping step 14 by the initial openings 18. The final stamping of the RF antenna 15 includes other features that may join the initial openings 18, but does not recut the initial openings 18. Therefore, the connecting pins 40 remain coated with the plating material 24 to the thickness that is desired to accomplish the soldering or create the joint with the circuit board.

Figure 7:
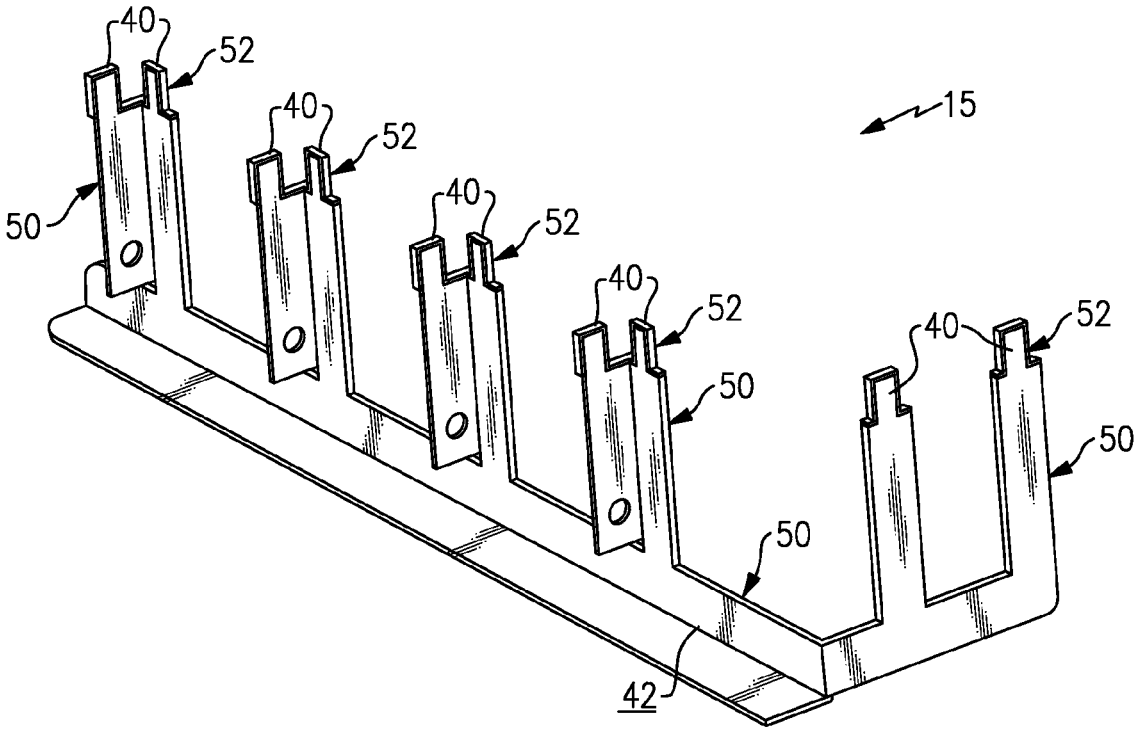
FIG. 7 is a perspective view of an example completed RF antenna.

Referring to FIG. 7, the example RF antenna 15 includes the connector pins 40 that include the plated surface 52 on the top, bottom and both sides. Other portions of the connector of the RF antenna 15 that were stamped and cut at the final stamping step 30 include plating on the top side, the bottom side and bare metal 50 on each of the first and second sides. The initial openings 18 defining the pins 40 expose the side so that plating can be deposited on the metal strip prior to final formation of the delicate features of the RF antenna 15.

Because of the initial stamping process defines surfaces of the completed RF antenna 15 that require plating, plating material can be applied prior to complete formation of the completed part 15. The plated coil with defined initial openings 18 provides for a final stamping process that generates a completed and plated part. No additional processes are required once the final stamping process is completed.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A method of fabricating antennas comprising the steps of:

a) removing portions of a metal coil to partially define features of a plurality of RF antennas within the metal coil, wherein the metal coil includes top and bottom surfaces and the partially defined features include surfaces transverse and between the top and bottom surfaces;

b) plating the metal coil on all surfaces including the surfaces transverse to the top and bottom surface for the partially defined features;

c) removing additional material from the plated metal coil to at least partially complete the form of the antenna; and d) separating the individually formed antenna from the metal coil.

2. The method as recited in claim 1, including the step of forming the antenna into a desired shape.

3. The method as recited in claim 1, wherein the step a) comprises maintaining the integrity of the metal coil after removing portions to partially define features of a plurality of antennas.

4. The method as recited in claim 1, wherein the step of removing portions of the metal coil comprises the step of forming slots that include at least one side forming a portion of a completed antenna.

5. The method as recited in claim 4, wherein the partially defined features removed from the metal coil define sides transverse to a top and bottom of a completed antenna.

6. The method as recited in claim 5, wherein the sides transverse to the top and bottom are plated during the step of plating exterior surfaces of the metal coil.

7. The method as recited in claim 1, wherein the removed portions of the coil include at least one side disposed between a top and bottom surface that comprises a final side of a completed antenna.

8. The method as recited in claim 1, wherein the plating comprises a material for generating a desired soldered joint.

9. The method as recited in claim 1, wherein the removed portions comprise an opening through the metal coils defined by a continuous uninterrupted side transverse to a top and bottom of the metal coil.

10. A method of fabricating a plurality of antennas comprising the steps of:

a) stamping a plurality of openings into a metal strip for defining a side of connecting pins for each of the plurality of antennas;

b) plating the entire metal strip with a material to facilitate a soldered joint, the plating material coating top, bottom and transverse surfaces of the connecting pins defined for each of the plurality of antennas; and c) stamping a final completed shape from the metal strip to form separate antennas.

11. The method as recited in claim 10, wherein the step of plating the metal strip includes plating sides of each of the plurality of openings.

12. The method as recited in claim 10, including the step of maintaining the metal strip in a coil form after stamping the plurality of openings.

13. The method as recited in claim 10, wherein the stamping of the final completed shape includes cutting through the metal strips at each of the plurality of openings to further define the connecting pins for each of a plurality of antennas.

14. The method as recited in claim 13, wherein the step of plating the metal strip includes plating the openings that define connecting pins such that all surfaces of the connecting pins are plated.

15. The method as recited in claim 10, including the step of bending the connecting pins to form a final shape of each of the antennas.

16. A method of fabricating a plurality of antennas comprising the steps of:

unrolling a coil of metal material;

stamping out a portion of the metal material to form an initial part of a connector for each of the plurality of antennas;

rerolling the metal material into a coil;

plating the rerolled coil such that a top, bottom and the side surfaces of the initial parts of the connector for each of the plurality of antennas is coated with a plating material;

unrolling the plated coil of metal material; and stamping a finish portion of the metal material to from remaining portions of each of the plurality of antennas, wherein the portions of material removed during stamping of the finish portion do not include plating on transverse surfaces and the initial part of the connector for each of the plurality of antennas includes plating material on a transverse side.

17. The method as recited in claim 16, wherein the plating material provides for the solder connection of each of the plurality of antennas to an electronic device.

18. The method as recited in claim 16, wherein the initial part of the metal materials includes surface that are disposed normal to side surfaces of the coil of metal material.

* * * * *